US007191878B2

(12) United States Patent
Lu

(10) Patent No.: US 7,191,878 B2
(45) Date of Patent: Mar. 20, 2007

(54) LUGGAGE HAVING A ROTATABLE HANDLE

(76) Inventor: Lien-Ching Lu, 19-12, Tianshin, Tianshin Li, Yuanli Jen, Miaoli Hsien (TW)

( * ) Notice: Subject to any disclaimer, the term of this patent is extended or adjusted under 35 U.S.C. 154(b) by 620 days.

(21) Appl. No.: 10/751,570

(22) Filed: Jan. 5, 2004

(65) Prior Publication Data

US 2005/0145459 A1 Jul. 7, 2005

(51) Int. Cl.
*B25G 1/04* (2006.01)
*A45C 7/00* (2006.01)

(52) U.S. Cl. ..... 190/115; 16/113.1

(58) Field of Classification Search ..... 190/115; 16/113.1

See application file for complete search history.

(56) References Cited

U.S. PATENT DOCUMENTS 6,508,344 B1 * 1/2003 Lu ..... 190/115
6,530,459 B1 * 3/2003 Lu ..... 190/115
6,564,426 B1 * 5/2003 Wang ..... 16/113.1
6,591,951 B1 * 7/2003 Chen ..... 190/115
6,830,135 B2 * 12/2004 Lin et al. ..... 190/115
6,920,666 B1 * 7/2005 Chen ..... 16/113.1
6,978,514 B2 * 12/2005 Kuo et al. ..... 16/113.1
2003/0102195 A1 * 6/2003 Mittleman et al. ..... 190/115

* cited by examiner

*Primary Examiner*—Tri M. Mai
(74) *Attorney, Agent, or Firm*—Alan D. Kamrath; Nikolai & Mersereau, P.A.

(57) ABSTRACT

A luggage includes a main body, a pull bar mounted on the main body, a positioning member mounted on the pull bar, and a handle rotatably mounted on the positioning member. Thus, the luggage has a horizontally rotatable handle, so that the handle is rotated relative to the pull bar so as to adjust the angle between the handle and the pull bar arbitrarily.

14 Claims, 6 Drawing Sheets

LUGGAGE HAVING A ROTATABLE HANDLE

BACKGROUND OF THE INVENTION

1. Field of the Invention

The present invention relates to a luggage, and more particularly to a luggage having a horizontally rotatable handle, wherein the handle is rotated relative to the pull bar so as to adjust the angle between the handle and the pull bar arbitrarily.

2. Description of the Related Art

A conventional luggage comprises a main body, a pull bar retractably mounted on the main body, and a handle mounted on the pull bar. The handle is usually parallel with the top of the main body. However, the handle has a single operation direction which is fixed without adjustment, so that the handle cannot fit the requirement of different users, thereby limiting the versatility of the handle.

SUMMARY OF THE INVENTION

The primary objective of the present invention is to provide a luggage having a horizontally rotatable handle.

Another objective of the present invention is to provide a luggage, wherein the handle is rotated relative to the pull bar to adjust the angle between the handle and the pull bar arbitrarily so as to fit the requirement of different users, thereby enhancing the versatility of the handle.

In accordance with the present invention, there is provided a luggage, comprising a main body, a pull bar mounted on the main body, a positioning member mounted on the pull bar, and a handle rotatably mounted on the positioning member, wherein:

the positioning member includes a positioning rod having a first end having a periphery formed with a plurality of opposite positioning holes;

the handle includes a first casing, a second casing, two movable blocks, a press knob, and two elastic members;

the first casing is rotatably mounted on the positioning rod of the positioning member and has two opposite ends each formed with a receiving recess;

the second casing is combined with the first casing and has a mediate portion formed with a limit slot;

each of the two movable blocks is slidably mounted in the respective receiving recess of the first casing and has a first end formed with a positioning post detachably locked in either one of the positioning holes of the positioning rod;

the press knob is movably mounted in the limit slot of the second casing and is provided with two opposite urging blocks each urged on the first end of a respective one of the two movable blocks to move the respective movable block; and each of the two elastic members is mounted in the respective receiving recess of the first casing and is urged on a second end of a respective one of the two movable blocks.

Further benefits and advantages of the present invention will become apparent after a careful reading of the detailed description with appropriate reference to the accompanying drawings.

DETAILED DESCRIPTION OF THE INVENTION

Figure 1:
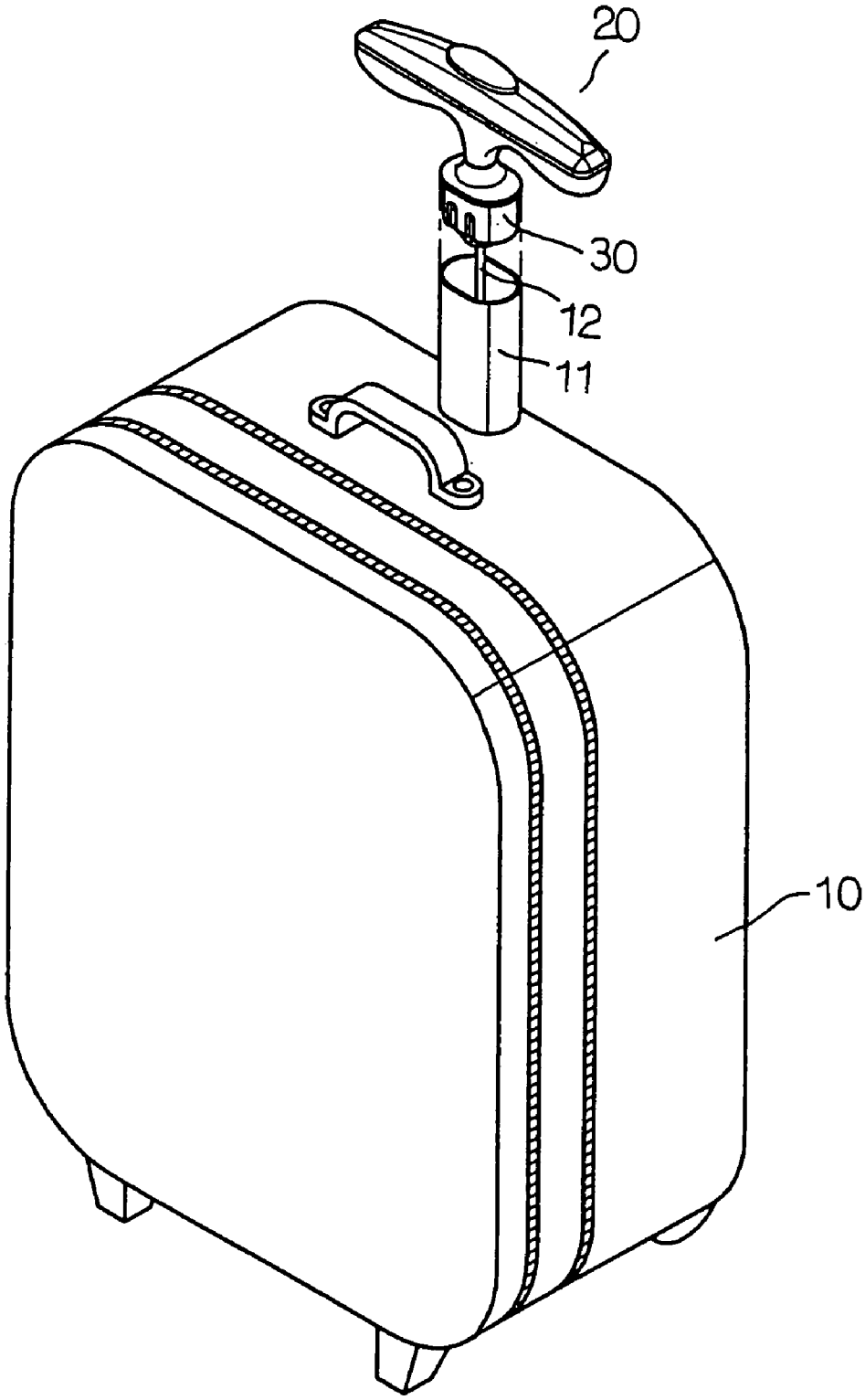
FIG. 1 is a perspective view of a luggage in accordance with the preferred embodiment of the present invention.
Figure 2:
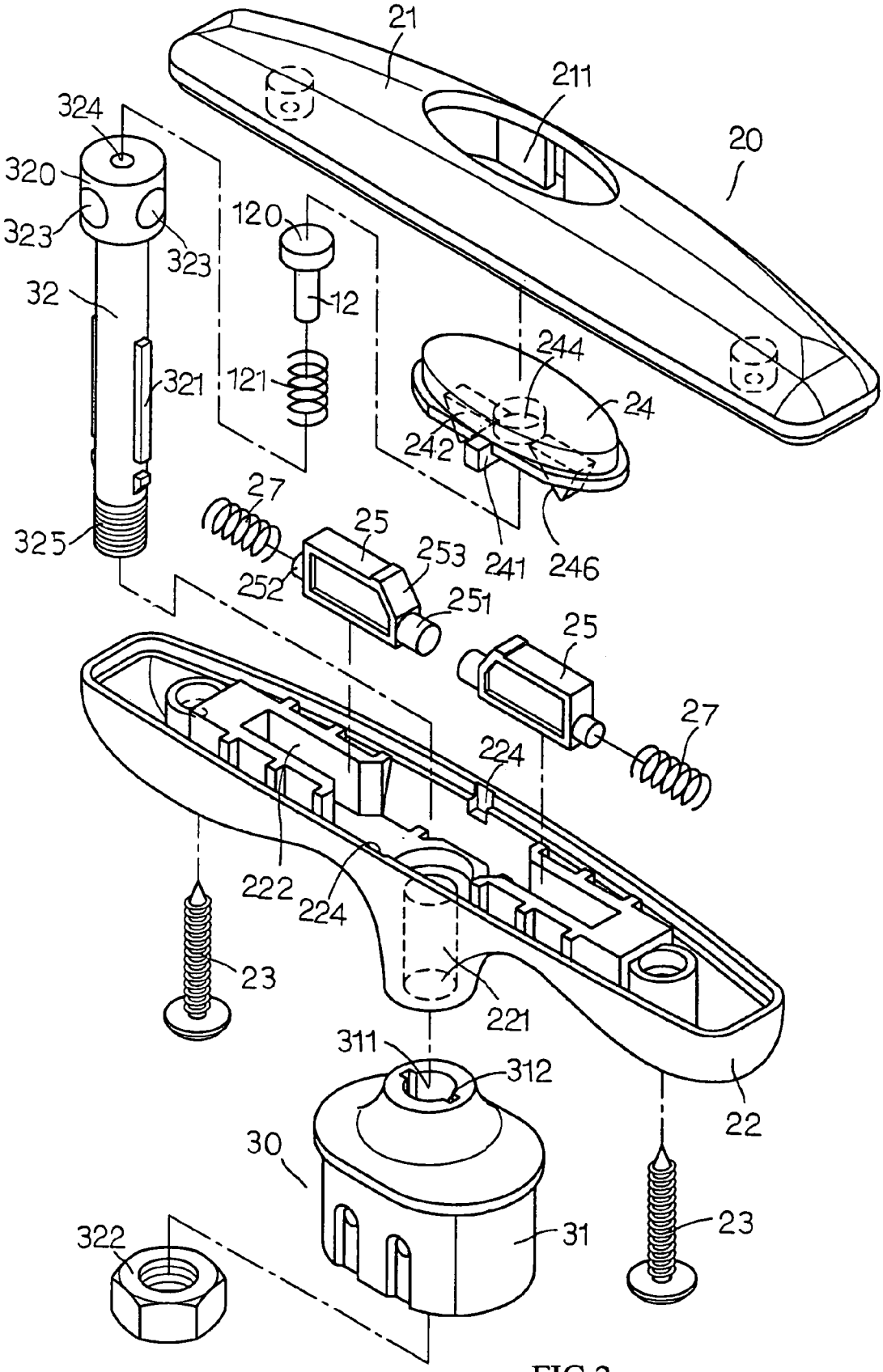
FIG. 2 is a partially exploded perspective view of the luggage in accordance with the preferred embodiment of the present invention.
Figure 3:
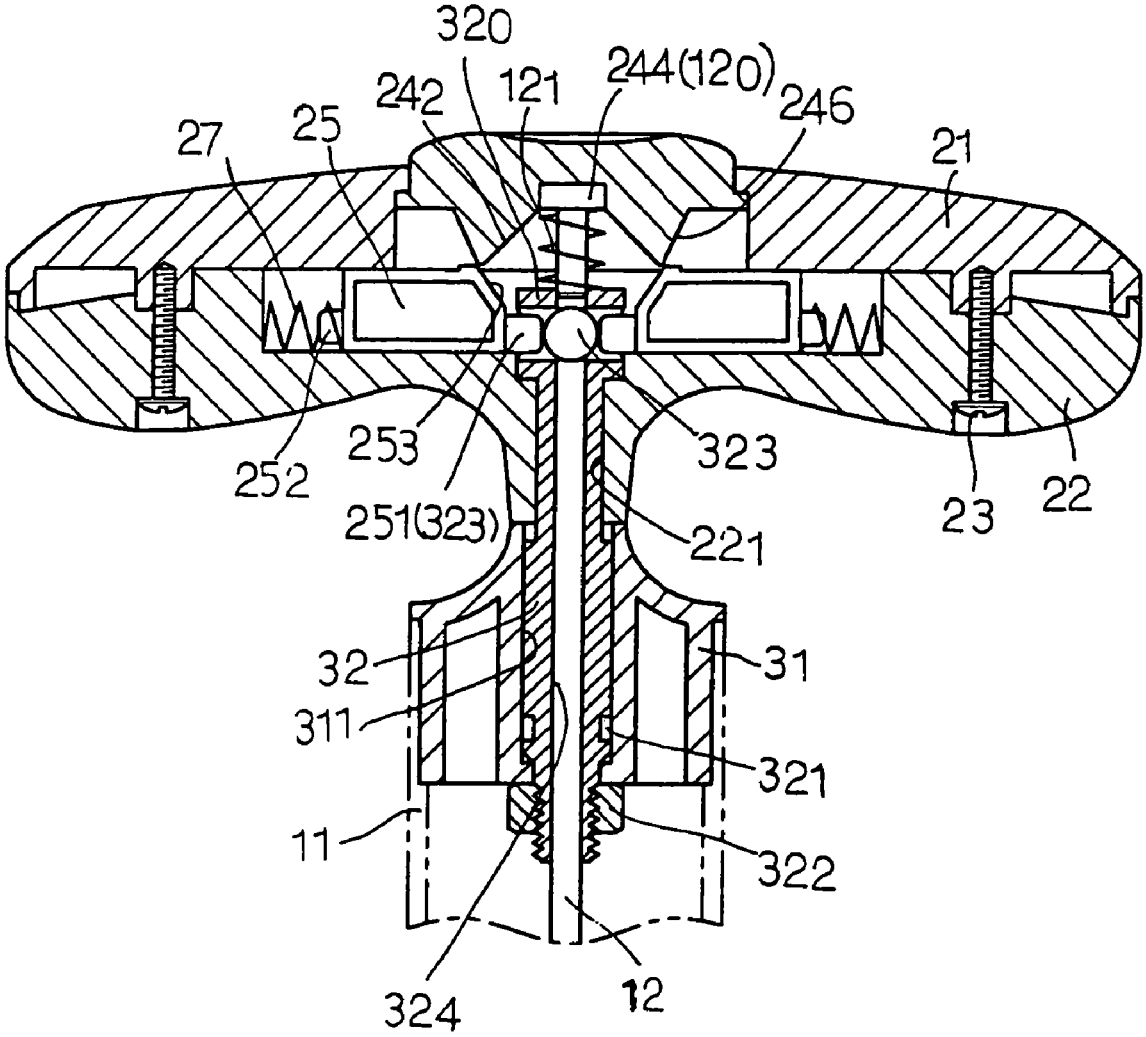
FIG. 3 is a plan cross-sectional assembly view of the luggage as shown in FIG. 2.

Referring to the drawings and initially to FIGS. 1–3, a luggage in accordance with the preferred embodiment of the present invention comprises a main body 10, a pull bar 11 mounted on the main body 10, a positioning member 30 mounted on the pull bar 11, a handle 20 rotatably mounted on the positioning member 30, and a control lever 12 movably mounted in the pull bar 11 and having a first end mounted on and driven by the handle 20 and a second end that is movable to push a control member (not shown) mounted on a bottom of the pull bar 11 to extend the pull bar 11 outward from the main body 10 or retract the pull bar 11 into the main body 10.

The positioning member 30 includes a support seat 31, a positioning rod 32, and a locking nut 322.

The support seat 31 is secured in the pull bar 11 and has an inside formed with a through hole 311 formed with two opposite keyways 312.

The positioning rod 32 is mounted in the through hole 311 of the support seat 31 and has an enlarged first end 320 protruding outward from a first end of the support seat 31 and a threaded second end 325 protruding outward from a second end of the support seat 31. The first end 320 of the positioning rod 32 has a periphery formed with a plurality of opposite positioning holes 323.

The positioning rod 32 of the positioning member 30 has an inner wall formed with a through hole 324 for mounting the control lever 12 and an outer wall formed with two opposite keys 321 secured in the two opposite keyways 312 of the support seat 31.

A spring 121 is mounted on the control lever 12 and has a first end urged on the first end 320 of the positioning rod 32 and a second end urged on an enlarged end 120 of the control lever 12.

The locking nut 322 is screwed onto the threaded second end 325 of the positioning rod 32 and rested on the second end of the support seat 31.

The handle 20 includes a first casing 22, a second casing 21, two movable blocks 25, a press knob 24, and two elastic members 27.

The first casing 22 is rotatably mounted on the positioning rod 32 and rested on the support seat 31 of the positioning member 30. The first casing 22 has a mediate portion formed with a through hole 221 for mounting the positioning rod 32, and the first end 320 of the positioning rod 32 is rested on the first casing 22 of the handle 20. The first casing 22 has two opposite ends each formed with a receiving recess 222 and has two opposite sides each formed with a limit cavity 224.

The second casing 21 is combined with the first casing 22 by a plurality of bolts 23. The second casing 21 has a mediate portion formed with a limit slot 221.

Each of the two movable blocks 25 is slidably mounted in the respective receiving recess 222 of the first casing 22 and has a first end formed with a positioning post 251 detachably locked in either one of the positioning holes 323 of the positioning rod 32 and a second end formed with a mounting post 252. The first end of each of the two movable blocks 25 has an edge formed with a ramp 253.

The press knob 24 is movably mounted in the limit slot 221 of the second casing 21 and is provided with two opposite urging blocks 242 each urged on the first end of a respective one of the two movable blocks 25 to move the respective movable block 25. Each of the two opposite urging blocks 242 is formed with a ramp 246 urged on the ramp 253 of the respective movable block 25. The press knob 24 has a periphery formed with two opposite limit blocks 241 each movably mounted in the respective limit cavity 224 of the first casing 22. The press knob 24 has an inside formed with a blind hole 244 for mounting the enlarged end 120 of the control lever 12.

Each of the two elastic members 27 is mounted in the respective receiving recess 222 of the first casing 22 and has a first end mounted on the mounting post 252 of a respective one of the two movable blocks 25 and a second end urged on a wall of the respective receiving recess 222 of the first casing 22.

As shown in FIGS. 1–3, the enlarged end 120 of the control lever 12 and the press knob 24 are pushed upward by the elastic force of the spring 121, and the two movable blocks 25 are pushed to move toward the first end 320 of the positioning rod 32 by the elastic force of the two elastic members 27, so that the positioning post 251 of each of the two movable blocks 25 is locked in either one of the positioning holes 323 of the positioning rod 32. Thus, the two movable blocks 25 are fixed on the positioning rod 32, so that the handle 20 is fixed on the positioning member 30.

Figure 4:
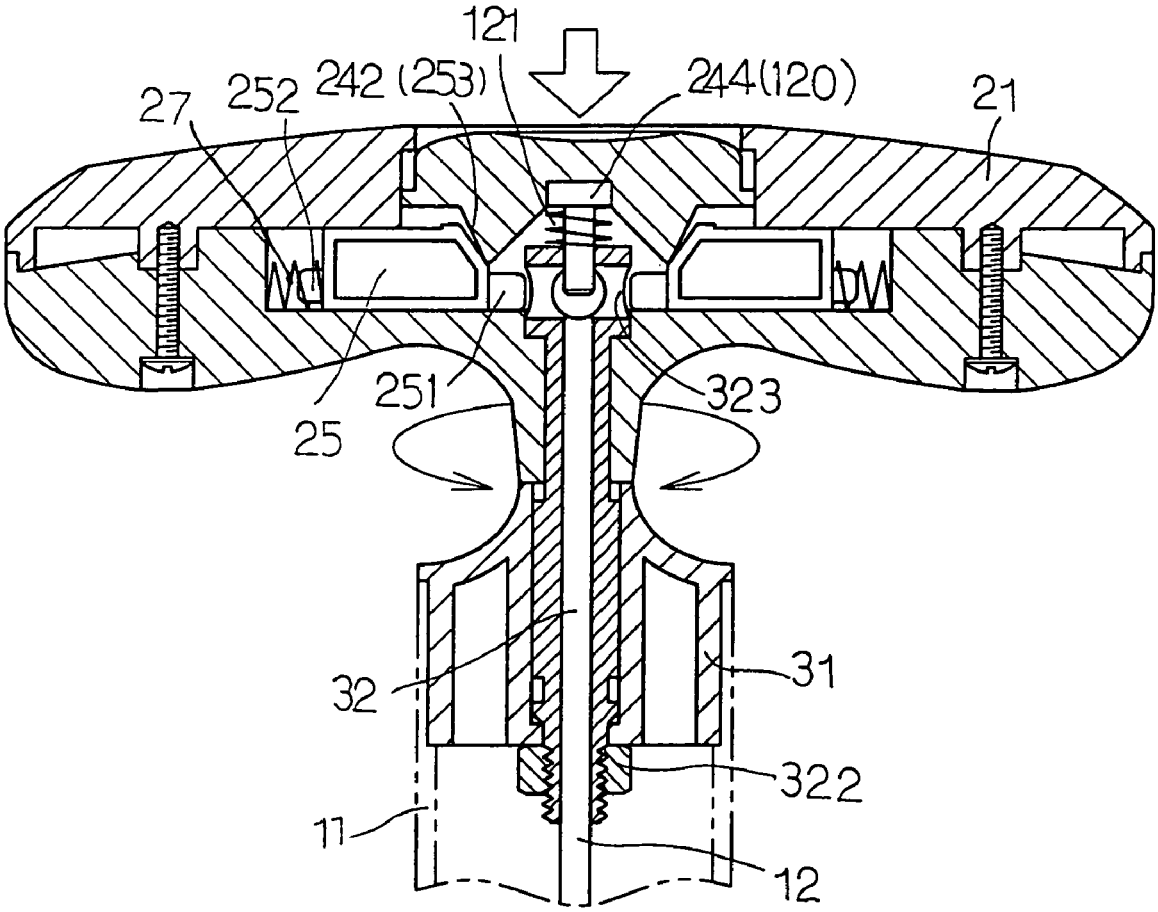
FIG. 4 is a schematic operational view of the luggage as shown in FIG. 3.

As shown in FIG. 4, when the press knob 24 is pressed to move toward the two movable blocks 25, the ramp 246 of each of the two opposite urging blocks 242 is urged on the ramp 253 of the respective movable block 25 to drive the two movable blocks 25 to move outward relative to the first end 320 of the positioning rod 32, so that the positioning post 251 of each of the two movable blocks 25 is detached from the respective positioning hole 323 of the positioning rod 32. Thus, the two movable blocks 25 are released from the positioning rod 32, so that the handle 20 is rotatable on the positioning member 30.

Figure 5:
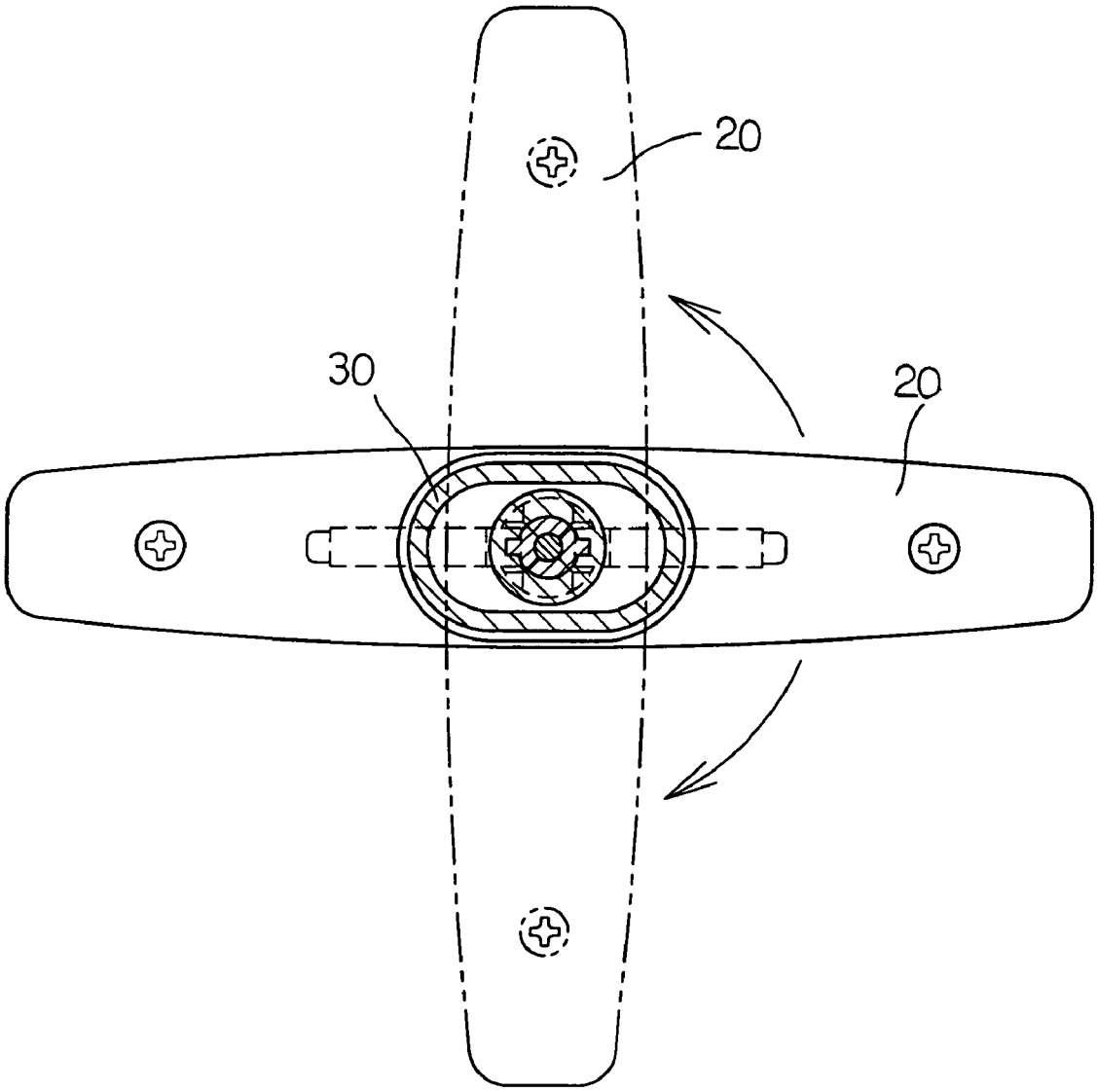
FIG. 5 is a top plan cross-sectional operational view of the luggage as shown in FIG. 1.
Figure 6:
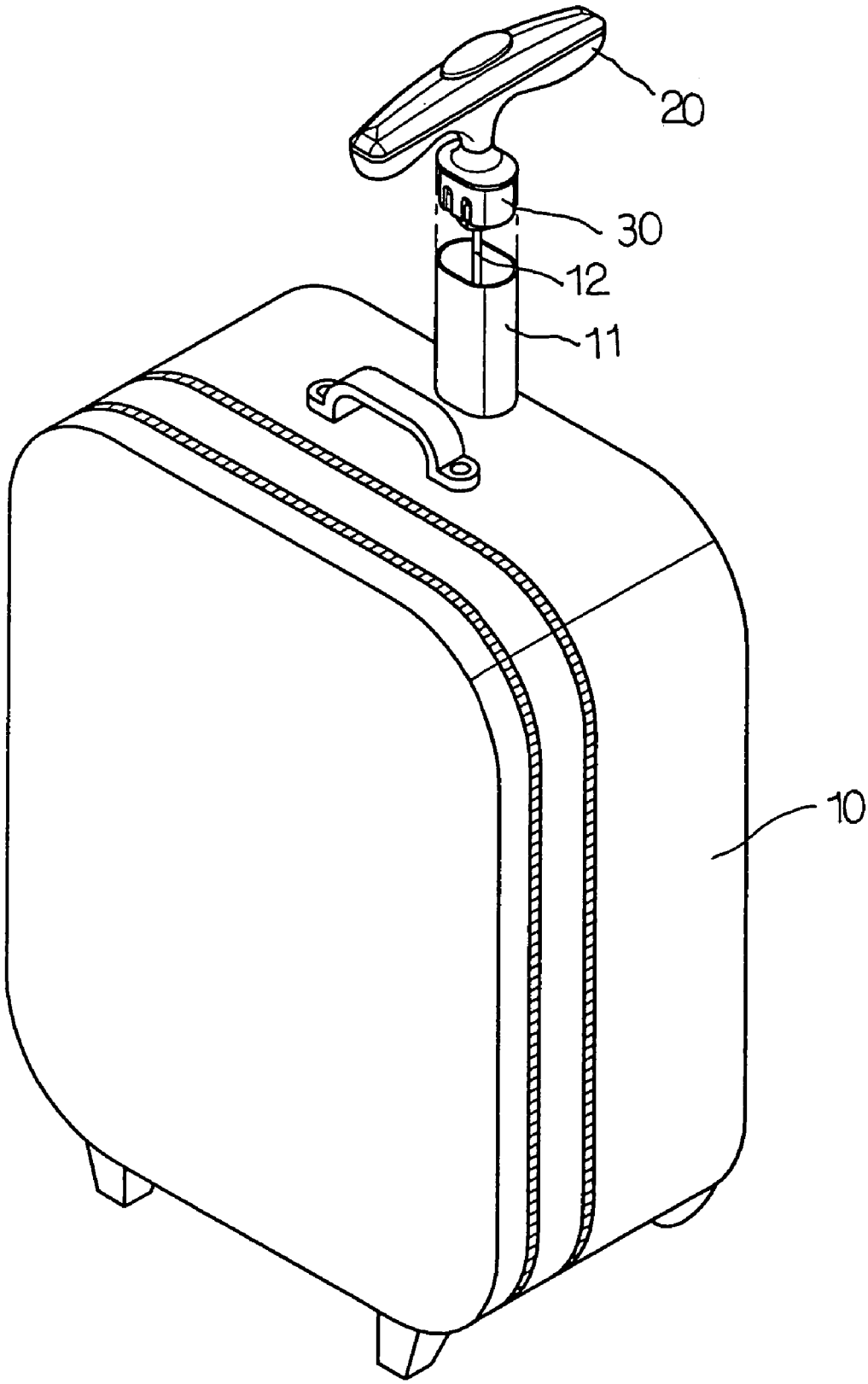
FIG. 6 is a schematic operational view of the luggage as shown in FIG. 1.

As shown in FIGS. 5 and 6, the handle 20 is rotated relative to the positioning member 30 so as to adjust the angle between the handle 20 and the positioning member 30.

After the force applied on the press knob 24 is removed, the enlarged end 120 of the control lever 12 and the press knob 24 are pushed upward by the restoring force of the spring 121, and the two movable blocks 25 are pushed to move toward the first end 320 of the positioning rod 32 by the restoring force of the two elastic members 27, so that the positioning post 251 of each of the two movable blocks 25 is locked in either one of the positioning holes 323 of the positioning rod 32. Thus, the two movable blocks 25 are fixed on the positioning rod 32, so that the handle 20 is fixed on the positioning member 30.

Accordingly, the handle 20 is horizontally rotated relative to the positioning member 30 to adjust the angle between the handle 20 and the positioning member 30 so as to fit the requirement of different users, thereby enhancing the versatility of the handle.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A luggage, comprising a main body, a pull bar mounted on the main body, a positioning member mounted on the pull bar, and a handle rotatably mounted on the positioning member, wherein:

the positioning member includes a positioning rod having a first end having a periphery formed with a plurality of opposite positioning holes;

the handle includes a first casing, a second casing, two movable blocks, a press knob, and two elastic members;

the first casing is rotatably mounted on the positioning rod of the positioning member and has two opposite ends each formed with a receiving recess;

the second casing is combined with the first casing and has a mediate portion formed with a limit slot;

each of the two movable blocks is slidably mounted in the respective receiving recess of the first casing and has a first end formed with a positioning post detachably locked in either one of the positioning holes of the positioning rod;

the press knob is movably mounted in the limit slot of the second casing and is provided with two opposite urging blocks each urged on the first end of a respective one of the two movable blocks to move the respective movable block; and each of the two elastic members is mounted in the respective receiving recess of the first casing and is urged on a second end of a respective one of the two movable blocks.

2. The luggage in accordance with claim 1, wherein the first casing has a mediate portion formed with a through hole for mounting the positioning rod.

3. The luggage in accordance with claim 1, wherein the first casing has two opposite sides each formed with a limit cavity, and the press knob has a periphery formed with two opposite limit blocks each movably mounted in the respective limit cavity of the first casing.

4. The luggage in accordance with claim 1, wherein the first end of each of the two movable blocks has an edge formed with a ramp, and each of the two opposite urging blocks of the press knob is formed with a ramp urged on the ramp of the respective movable block.

5. The luggage in accordance with claim 1, wherein the second end of each of the two movable blocks is formed with a mounting post, and each of the two elastic members has a first end mounted on the mounting post of a respective one of the two movable blocks and a second end urged on a wall of the respective receiving recess of the first casing.

6. The luggage in accordance with claim 1, wherein the positioning member further includes a support seat secured in the pull bar and having an inside formed with a through hole, and the positioning rod is mounted in the through hole of the support seat.

7. The luggage in accordance with claim 6, wherein the through hole of the support seat is formed with two opposite keyways, and the positioning rod of the positioning member has an outer wall formed with two opposite keys secured in the two opposite keyways of the support seat.

8. The luggage in accordance with claim 6, wherein the first end of the positioning rod is protruding outward from a first end of the support seat and is rested on the first casing of the handle.

9. The luggage in accordance with claim 6, wherein the positioning rod has a threaded second end protruding outward from a second end of the support seat, and the positioning member further includes a locking nut screwed onto the threaded second end of the positioning rod and rested on the second end of the support seat.

10. The luggage in accordance with claim 6, wherein the first casing is rested on the support seat of the positioning member.

11. The luggage in accordance with claim 1, further comprising a control lever movably mounted in the pull bar and having an enlarged end mounted on and driven by the handle.

12. The luggage in accordance with claim 11, wherein the press knob has an inside formed with a blind hole for mounting the enlarged end of the control lever.

13. The luggage in accordance with claim 11, wherein the positioning rod of the positioning member has an inner wall formed with a through hole for mounting the control lever.

14. The luggage in accordance with claim 11, further comprising a spring mounted on the control lever and having a first end urged on the first end of the positioning rod and a second end urged on the enlarged end of the control lever.

* * * * *